US005312042A

United States Patent [19]

Larson

[11] Patent Number: 5,312,042

[45] **Date of Patent: * May 17, 1994**

[54] SPRAY APPARATUS COMPRISING A VORTEX TUBE

[75] Inventor: John C. Larson, Clarkston, Mich.

[73] Assignee: E. I. Du Pont de Nemours and Company, Wilmington, Del.

[ * ] Notice: The portion of the term of this patent subsequent to Nov. 30, 2010 has been disclaimed.

[21] Appl. No.: 110,621

[22] Filed: Aug. 26, 1993

Related U.S. Application Data

[63] Continuation of Ser. No. 738,677, Jul. 31, 1991, abandoned, which is a continuation-in-part of Ser. No. 707,991, May 23, 1991, which is a continuation of Ser. No. 305,441, Feb. 2, 1989, abandoned.

[51] Int. Cl.[5] ..... B05B 7/16

[52] U.S. Cl. ..... 239/135; 239/124; 239/290

[58] Field of Search ..... 239/1, 8, 11, 13, 124, 239/135, 290, 296, 340, 364, 365; 62/5

[56] References Cited

U.S. PATENT DOCUMENTS

| | | | |
|---|---|---|---|
| 3,019,621 | 2/1962 | Lawson | 62/5 X |
| 3,208,229 | 9/1965 | Fulton | 62/5 |
| 3,214,923 | 11/1965 | Palmisano et al. | 62/5 |
| 3,336,463 | 8/1967 | Johnson | 239/135 X |
| 3,884,819 | 5/1975 | Shultz et al. | 62/5 X |
| 4,240,261 | 12/1980 | Inglis | 62/5 |
| 4,333,754 | 6/1982 | Peter | 62/5 |
| 4,339,926 | 7/1982 | Moretti et al. | 62/5 |
| 4,964,569 | 10/1990 | Stevens | 239/13 |
| 5,078,322 | 1/1992 | Torntore | 239/296 X |

FOREIGN PATENT DOCUMENTS 803984 2/1981 U.S.S.R. .

*Primary Examiner*—Andres Kashnikow
*Assistant Examiner*—William Grant
*Attorney, Agent, or Firm*—Chris P. Konkol

[57] ABSTRACT

A system for spraying a coating onto a substrate employing a vortex tube to supply warm air to a spray gun is disclosed. The system allows precise control of air temperature.

6 Claims, 2 Drawing Sheets

SPRAY APPARATUS COMPRISING A VORTEX TUBE

CROSS REFERENCE TO RELATED APPLICATIONS

This is a continuation of application Ser. No. 07/738,677 filed Jul. 31, 1991, now abandoned, which is a continuation-in-part of Ser. No. 07/707,991, filed May 23, 1991, which is a continuation of application Ser. No. 07/305,441, filed Feb. 2, 1989 now abandoned.

FIELD OF THE INVENTION

This invention relates to an improved spray apparatus employing a vortex tube. This spray apparatus supplies warm pressurized air to an air blast type of atomizer and is useful in the spray application of coatings.

BACKGROUND

The application or spraying of coatings onto various substrates by the use of spray guns is well known. Such spraying typically has been accomplished by means of several types of atomizers, including the following: (1) conventional high pressure air blast atomizers; (2) HVLP (high volume, low pressure) air blast atomizers; (3) airless, high pressure atomizes; and (4) air assisted airless atomizers. Each of these types of atomizers have their own characteristics which make them more or less desirable to be used in the application of a particular coating material or paint, or on a particular substrate, or in a particular setting or location. Other factors, such as govermental regulations, now are beginning to dictate the type of atomizer which can be used.

Recent actions by governmental agencies include efforts to reduce the atmospheric emissions of hydrocarbon solvents that form ozone in the lower atmosphere. Two regulatory approaches have especially affected the spray coatings industry. One approach is the lowering of the permitted levels of hydrocarbon solvent or volatile organic content (VOC) in paints. This approach would reduce emissions because, if the same amount of solids is applied, less solvent would be sprayed and released to the atmosphere. Another approach is the limiting of the allowable air pressure that can be employed for atomizing paint in air blast type spray guns. Spraying with lower atomizing air pressure increases the spray droplet size, which reduces the number of very small droplets that can be carried away with air currents (overspray). This results in a higher transfer efficiency, or, in other words, more of the paint solids end up on the surface being painted and less is wasted.

Lower VOC regulatory limits are resulting in the development of paints with less hydrocarbon solvents (higher solids) or with water as the solvent (water based). The high solids paints are higher in viscosity and harder to atomize, and the water based paints dry or cure more slowly, especially in cool and humid weather conditions. These new kinds of paints have suggested the need for new or different applicators or spraying methods.

The above mentioned limit on atomizing air pressure has resulted in a multitude of new spray guns being offered for sale. They are referred to as HVLP (high volume, low pressure) spray guns. During use, the air pressure utilized in such a gun is less than or equal to 10 psig, as measured just inside the air exit orifice. The combination of lower VOC paints and lower atomizing air pressure has resulted in a decrease in atomizing quality (average droplet size in the spray). This makes it difficult for the operator of the spray gun to achieve the desired finish appearance that satisfies the customer.

Initially, most HVLP systems included a turbine to supply a high volume of air at low pressure to a spray gun. In the process of compressing air, the air is naturally warmed, so that turbine spraying systems can provide warm atomizing air.

High volume, low pressure (HVLP) spraying is alternately called turbine spraying, since the normal method of supplying air for atomizing paint is a turbine. However, another method of supplying warm air involves a compressed air conversion unit. This is simply a common pressure regulator that reduces the compressed air pressure down to below 10 psig. This low pressure air is then heated to 100° to 200° F. by means of an electric resistance heater.

Both of the above-mentioned methods of providing warm air, turbine spraying and the use of compressed air conversion units, have certain drawbacks. For instance, turbines have moving parts that can break down and that require occasional maintenance. Turbines also require electrical power to operate, which must be explosion proof when used in areas that are classified as electrically hazardous according to the National Electric Code. Also, the control of air temperature is not precise with turbines. In most cases, the temperature is only controlled by the length of air hose connected between the turbine and the spray gun. Further, the initial capital costs of a turbine system is relatively high. This expense is especially high if pressures higher than about 5 psig are desired, since turbines employed in refinish shops are usually so limited. Likewise, a compressed air conversion unit suffers from similar drawbacks. The temperature control of these units is typically accomplished with a thermostat employing on-off control and resulting in significant temperature cycling. In order to make this type of unit suitable for electrically hazardous areas, expensive purging or an expensive explosion proof mounting box would be required.

There exists a need for a source of warm atomizing air for spray guns which is inexpensive, requires little or no maintenance, has simple and precise temperature adjustment, and is explosion proof.

DETAILED DESCRIPTION OF THE INVENTION

We have found that a spray system comprising a vortex tube provides an improved means of supplying warm air for atomizing and applying paint to a substrate.

Vortex tubes are commercially available and have been fully disclosed in the prior art, for example, in U.S. Pat. No. 3,208,229, herein incorporated by reference in its entirety. Such vortex tubes, however, have been used mainly for industrial cooling applications. The vortex tube is a low cost, reliable, maintenance free device which, using an ordinary supply of compressed air as a power source, creates two streams of air, one hot and one cold. Vortex tubes can produce temperatures ranging from −40° F. to more than 200° F., flow rates ranging from 1 to 100 SCFM, and refrigeration up to 6,000 BTU/hr. Furthermore, temperatures and air flows are adjustable over a wide range using a control valve on the warm end exhaust.

The vortex tube works by injecting compressed air (typically 30–100 psig) tangentially into the vortex spin chamber. At more than 500,000 RPM, this air stream revolves toward the hot end where some escapes through the control valve. The remaining air, still spinning, is forced back through the center of this outer vortex. The inner stream gives off kinetic energy in the form of heat to the outer stream and exits the vortex tube as cold air. The outer stream exits the other end as hot air.

Vortex tubes are available commercially from several companies including Vortec Corporation (Cincinnati, Ohio) and Exair Corporation (Cincinnati, Ohio). In order to determine the optimum operating conditions for a specific spray application it would be necessary to experiment with various warm air pressures, flow rates and temperatures. These variables can be modified by either using different size vortex tubes, adjusting the warm air exhaust valve or changing the cold air passage diameter on the same vortex tube.

Our experimental work thus far has been on high solids automotive refinish paints such as Imron ® 5000 from Du Pont. (Although the invention is capable of being utilized with any coating material which can be sprayed). Of the commercially available, "off the shelf" vortex tubes, we have found that, for our purposes, a preferred vortex tube is the Model 328-75-H, available from Vortec Corporation. Smaller vortex tubes did not provide high enough temperature, pressure and flow. Larger vortex tubes consumed excessive compressed air and provided temperature, pressure and flow which were in excess of what was required in a one spray gun process. The preferred spray gun was found to be the DeVilbiss Model JGHV-501. However, it will be apparent to one skilled in the art that any of a number of commercially available spray guns could be used, depending upon the specific application. In fact, this invention could be potentially utilized in any spray application.

Figure 1:
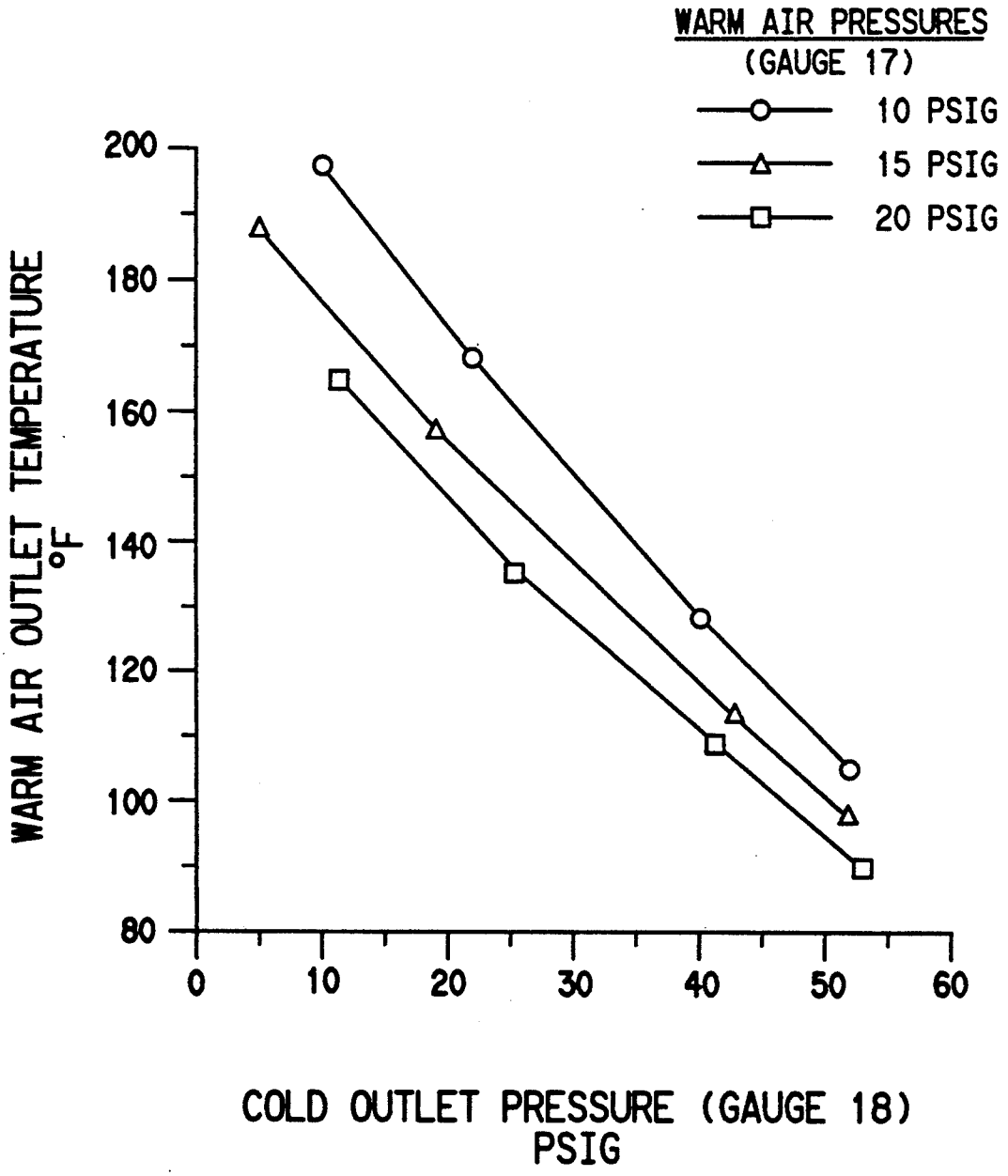
FIG. 1 shows the relationship between the warm air temperature supplied by vortex tube versus the cold air pressure for various constant warm air pressures using 60 psig supply air to a Vortec Model 328-75-H vortex tube.

The Model 328-75-H supplies warm air within the parameters shown in FIG. 1. We have found that for Imron ® 5000 paint sprayed with the DeVilbiss Model JGHV-501 spray gun, the optimum warm air supply to the spray gun is 12–18 SCFM at 5–15 psig and the optimum temperature of the air exiting the spray gun is 90° F.–110° F. These conditions optimized film appearance and spray transfer efficiency.

Although certain ranges of operating conditions, for example pressures, temperatures and air flow rates, may be preferred, such preferred ranges may depend on economics such as compressed air consumption, transfer efficiency, film quality and productivity. The ranges of operating conditions may also depend on the coating composition being applied, which can be a metallic or non-metallic paint, primer, primer surfacer, monocoat, or non-pigmented clearcoat. Such compositions may be one or two package systems and can be based on a variety of chemistries, including, but not limited to, epoxy/anhydride, polyurethane, acrylic, acrylic polyol, or silane based compositions, involving various cross-linking agents such as polyisocyanates or amine bearing compounds. Since the needs of users vary widely, suitable operating ranges may also vary widely. In a typical refinish shop, it may be desirable for the temperature of the warm air exiting the spray apparatus to range from 80° to 130° F., preferably 90° to 110° F., and pressure within the aircap of a spray gun (just within the air exit orifice) to range from about 5 to 15 psig, preferably 5 to 10 psig. The ratio of the mass of warm air to the mass of fluid (paint) suitably ranges from 2.0 to 4.0, preferably 2.8 to 3.2. Depending on the upper capacity of the air supply, the air supply to the vortex tube may range from about 30 to 80, more narrowly 40 to 60 psig.

Figure 2:
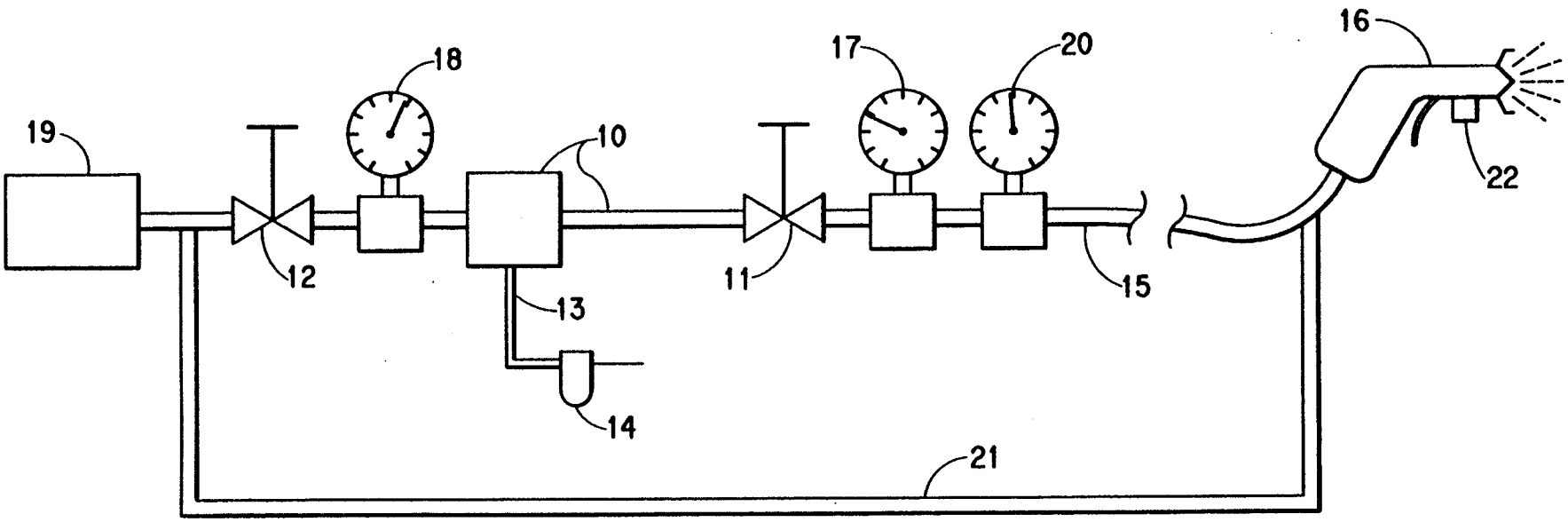
FIG. 2 shows a schematic diagram of an embodiment of the present invention in which a vortex tube is connected to a spray gun.

FIG. 2 shows a schematic diagram of one embodiment of the present invention in which a vortex tube 10 is connected to spray gun 16. The warm air pressure to the spray gun may be first varied by adjusting warm air flow control valve 11 (which is normally included as an integral part of the purchased vortex tube). The warm air temperature may be varied by first adjusting the cold air pressure with a cold air flow control valve 12. It is noted, however, that adjustments to either valve can influence the parameter controlled by the opposite valve, and thus concurrent or alternate iterations of fine-tuning of both valves may be necessary. The cold air control valve 12 is not found on vortex tubes bought off the shelf and therefore must be installed by adding pipe fittings to the cold end of the vortex tube. It will be apparent to one skilled in the art how to add such conventional pipe fittings. It may also be desirable to have a pressure gauge 18 before valve 12 and a muffler 19 on the cold air exhaust.

The inlet of the vortex tube is connected to compressed air line 13 which includes air filter 14 to filter out possible contaminants such as dirt and oil. An optional conventional drying unit may also be employed to remove water or moisture from the air. The air in line 13 is suitably between 40 to 60 psig. The warm air exit from the vortex tube is connected with an appropriate flexible hose 15 to the spray gun 16. The paint enters the spray gun under pressure through a fluid connection 22, which is typically connected to a hose, cup or other means of conveying paint under pressure. It may also be desirable to install a warm air pressure gauge 17 and a warm air temperature gauge 20 between valve 11 and spray gun 16.

In operation of the present system for spraying paint or finishes, the important variables are the temperature of the warm air and the aircap pressure of the spray gun. In general, the aircap pressure may be changed by adjusting the volume of air flowing to the spray gun. In general, the warm air temperature may be adjusted by changing the fraction of total air that is passing out the warm end of the vortex tube.

Adjusting the cold air valve closed will change the warm air fraction by forcing more air out of the warm end. A higher warm air fraction results in a lower warm air temperature. This adjustment also results in a higher aircap pressure in the spray gun as a higher volume of air is forced out the fixed air orifices of the spray gun. The opposite adjustment of the cold air valve has an opposite effect.

Adjusting the warm air valve closed reduces the warm air fraction as more air is forced out the cold end. As a result, the warm air temperature increases. The reduced warm air volume to the spray gun results in lower aircap pressure. Again, opposite adjustments have an opposite effect.

Increasing the inlet air pressure to the vortex tube does not affect the warm air fraction appreciably within a preferred operating range of 40 to 60 psig. The aircap pressure, however, increases proportionately as shown in FIG. 1.

In order to increase the aircap pressure while maintaining a constant temperature, alternate methods may be employed. These two methods have the effect of increasing the internal pressures of the vortex tube without changing the warm air fraction. The first method involves increasing the inlet air pressure. The second method involves opening the warm air valve to allow more air volume to the spray gun, followed by opening the cold air valve to return to the same warm air fraction. The adjustments in this second method may have opposite effects on both variables; however, the aircap pressure is typically more sensitive to the adjustments than the temperature. As a result, the warm air valve may be adjusted first to an aircap pressure higher than desired, then the cold air valve adjustment may be used to correct the aircap pressure to the desired level as the warm air fraction is returned to the original value.

The warm air fractions may not be easily measured and monitored directly, so that a graph as shown in FIG. 1 may be developed to allow quick adjustments of the two valves by reading the pressures on gauges 17 and 18. The warm air pressures from gauge 17 are easily related to the aircap pressures. The resulting aircap pressure, for each gauge 17 reading, is dependent on the length of hose and restrictions that cause pressure drop between gauge 17 and the spray gun's aircap.

Regarding the present use of a vortex tube as a warm air source for spray guns, the fact that the prior art does not show or suggest such a use is not surprising. A vortex tube operates best with a continuous flow of air to reach equilibrium temperatures, whereas paint spraying typically does not operate under continuous flow conditions. The person applying the paint typically triggers the spray gun to start the flow of air and paint liquid, and in order to stop, releases the trigger. The actual time that air and paint liquid is flowing may be less than 50 percent much of the time.

The problem of on-off operation of a spray gun may be solved by adding an alternate means of receiving warm air from the vortex tube when the spray gun is sporadically stopped. A bleed line 21 may be employed for this purpose. Although some spray guns are designed to bleed air continuously out their air cap orifices to accommodate warm air supplied by turbines, this is not desirable, in that the bleeding air can stir up dirt from spray booth floors and deposit the dirt on freshly painted surfaces. On the other hand, if the warm air does not bleed, or continuously flow, the temperature of the air at the spray gun decreases. By installing a bleed line 21, the vortex tube can operate continuously to provide a constant air temperature at the spray gun. This also permits the use of a non-bleeding air gun, which is very desirable. Furthermore, by bleeding the air to a point between valve 12 and muffler 19, additional back pressure can be provided at the discharge of valve 12, reducing the air flow through valve 12 which in turn reduces compressed air consumption.

It is also quite possible that future spray guns might be designed such that the vortex tube is an integral part of the gun itself. In addition, it is foreseeable that the warm air might be used to heat the paint prior to atomization by means of various heat exchanger devices. It is also conceivable that the warm air supply could be used purely as a carrier and shaper of paint spray which has been atomized by other methods (e.g. electrostatic, ultrasonic, rotary, or centrifugal).

Several significant benefits were found in using warm atomizing air in painting operations according to the present invention. First, the warm atomizing air heats up the atomizer (spray gun) which in turn warms the paint as it comes in contact with the metal parts of the gun. The warmer paint atomizes easier because the increased paint temperature lowers the viscosity. This could result in better quality and appearance of the coating and/or permit the use of high solids, low VOC paint without loss in coating quality.

As a second benefit, the warm atomizing air produces a warmer and drier atmosphere around the paint droplets as they travel from the atomizer to the substrate being painted. This results in a greater driving force for solvent evaporation from the droplets, which compensates for the lesser surface area due to the larger droplets that are inherent with atomization using less than 10 psig air pressure.

As a third benefit, the warm air being supplied to the spray gun does not have the problem of water condensation associated with typical compressed air supply systems. The cold, compressed air expands as the pressure drops in the spray gun and/or just outside the air exit orifice. As the air expands, water tends to condense when the air is not sufficiently dry.

Several experiments were carried out to determine the effects of warm air in spraying paint. In one experiment, a high solids urethane paint (Du Pont's Imron TM 5000 paint) was sprayed first with normal cold (60° F.) compressed air, then with warm (120° F.) atomizing air by means of a spray apparatus according to the present invention. The paint was applied to pre-primed steel panels (12 in × 18 in) according to the application directions for the paint being sprayed. After drying and curing, the panels were rated for "orange peel" (texture) against visual standards from 1 to 10. The highest rating (10) is for a very smooth glass like appearing film. The panel sprayed with cold air was rated 6.5, whereas the panel sprayed with the warm air was rated 8.0. This indicated that the paint flowed out more smoothly when employing the present spray apparatus and warm atomizing air. Other similar experiments with various high solids paints gave similar results.

Water based paints were also sprayed with standard cold compressed air and then with warm atomizing air by means of the present invention. The effect of the warm atomizing air on the dry time of the paint was observed. With all ambient conditions equal and the same film thickness applied, all the tests showed that the warm atomizing air reduced the dry time for the water based paint by 30 to 35%. In one case, the panel sprayed with cold air dried in 25 minutes, while the panel sprayed with warm air according to the present invention dried in 17 minutes.

Although the present invention can be used to provide a wide range of pressures, it is especially useful for providing high volume, low pressure (HVLP) air, which is normally less than 15 psig, preferably not greater than about 10 psig, at a temperature in excess of the ambient temperature. As indicated earlier, the HVLP route to atomize paint is gaining increasing acceptance over previous methods because of higher transfer efficiency resulting from the lower atomizing pressure which minimizes overspray and bounceback. Additionaly, the softer delivery prevents paint from being forced under masks. Although, the warm air is especially beneficial for atomizing high-solids paint, the present invention has wide applicability to a variety of paints.

As mentioned above, an important characteristic of the present spray system, compared to other prior art systems, is the fact that temperature can be readily controlled to within 2° F. In contrast, the temperature variation in a compressed air converter is typically only within 10°-15° F., and the temperature with a turbine system is typically adjustable only by adding or removing lengths of hose, which is inconvenient and less than precise.

Another important advantage of the present spray system, with warm air supplied by a vortex tube, is that of lower initial cost. It's simplicity and the fact that it can be used in electrically hazardous areas, as is, makes the cost of it much less than that equipment used in other methods. In addition, the present invention takes advantage of a utility (compressed air) that is already installed at sufficient capacity in most of the companies that are involved in spray application of coatings.

EXAMPLE

An experiment was run using a Vortec 328-75-H vortex tube configured as shown in FIG. 2 above, except without the bleed line. The spray gun utilized was a DeVilbiss Model JGHV-501. The adjusting valves on the vortex tube were adjusted so that the warm air supply to the spray gun was at about 15 psig, about 100° F. and 17-18 SCFM. With a consistent compressed air supply, it was easy to control the temperature within 2° F. once a steady state was found.

The paint sprayed was Du Pont's Imron TM 5000 high solids refinish paint. Various size panels were hand sprayed from a gun distance of 10-12 inches, and a gun speed of 2-3 feet per second. No problems were found with gun surface temperature. Some sprayed panels were ambient cured and others were oven cured. The finished panels were evaluated visually and were found to be equal to or better than conventional air atomized panels in terms of appearance, color, and film build.

Various modifications, alterations, additions, or substitutions to the above describe invention will be apparent to those skilled in the art without departing from the scope and spirit of this invention and it should be understood that this invention is not unduly limited to the illustrative embodiments set forth herein.

I claim:

1. An apparatus for spraying a coating material onto a substrate, comprising (a) a means for supplying compressed air to a vortex tube unit;

(b) a vortex tube unit for receiving the compressed air at a first inlet and for delivering relatively cold air to a cold air conduit and for delivering warm air to a warm air conduit;

(c) first control means in said warm air conduit for adjusting the pressure of the warm air;

(d) second control means in said cold air conduit for adjusting the pressure of the relatively cold air; and (e) connected with said warm air conduit, a spray means for employing the warm air to atomize the coating material during its application onto the substrate being coated.

2. The apparatus of claim 1, further comprising a means for measuring the pressure in the warm air conduit.

3. The apparatus of claim 1, further comprising a means for measuring the pressure in the cold air conduit.

4. The apparatus of claim 1, further comprising a means for measuring the temperature of the warm air.

5. The apparatus of claim 1, wherein the means for supplying compressed air is a compressor.

6. The apparatus of claim 1, further comprising a muffler for the relatively cold air produced by the vortex tube unit, before the relational cold air is exhausted into the ambient environment.

* * * * *